United States Patent [19]

Philipp et al.

[11] Patent Number: 4,685,284

[45] Date of Patent: Aug. 11, 1987

[54] METHOD OF PRODUCING A TWISTED YARN

[75] Inventors: Peter R. Philipp, Charlotte, N.C.; Jean Weber, Brussels, Belgium

[73] Assignee: Maschinen Fabrik Schärer AG, Erlenbach, Switzerland

[21] Appl. No.: 809,063

[22] Filed: Dec. 12, 1985

[30] Foreign Application Priority Data

Dec. 20, 1984 [CH] Switzerland ..... 6079/84

[51] Int. Cl.[4] ..... D01H 13/30; D01H 1/00; B65H 54/08

[52] U.S. Cl. ..... 57/295; 8/151.2; 8/154; 8/155; 57/296; 57/309; 57/313; 242/42; 242/166

[58] Field of Search ..... 57/313, 295, 296, 309; 8/154, 155, 155.1, 151.2; 242/42, 166

[56] References Cited

U.S. PATENT DOCUMENTS

| | | | |
|---|---|---|---|
| 833,374 | 10/1906 | Detre | 242/42 X |
| 1,348,167 | 8/1920 | Graves | 8/155.1 |
| 2,203,721 | 6/1940 | Dingley et al. | 57/313 X |
| 2,345,538 | 3/1944 | Lewis | 242/42 |
| 2,451,533 | 10/1948 | Cannon | 242/166 X |
| 2,738,144 | 3/1956 | Honig | 242/166 |
| 2,906,593 | 9/1959 | Abbott | 8/155 X |
| 2,944,383 | 7/1960 | Lawrence et al. | 57/313 X |
| 2,972,856 | 2/1961 | Hamel | 57/313 |
| 3,458,983 | 8/1969 | Hamel | 57/313 X |
| 4,020,998 | 5/1977 | Carbonell et al. | 242/39 |

FOREIGN PATENT DOCUMENTS 2283976 4/1976 France .

*Primary Examiner*—John Petrakes
*Attorney, Agent, or Firm*—Peter K. Kontler

[57] ABSTRACT

A method of producing twisted yarn comprises precision doubling several single yarns in a precision assembly winder to form a precision package which is dyed or bleached. The yarn is thereupon twisted during withdrawal from the precision package.

6 Claims, No Drawings

METHOD OF PRODUCING A TWISTED YARN

LIST OF REFERENCES

Applicants are aware of the disclosures of U.S. Pat. No. 4,020,998 (corresponding to FR-A2 259 775), FR-A-2 283 976, NL-A-7501160, DE-A-2504403, GB-A-1491731, CH-A-594097, JP-A-50107239, SE-B-401163, SE-A-7500838 and DE-A-2537922. U.S. Pat. No. 4,020,998 discloses a method and an apparatus for winding bobbins preparatory to dyeing. FR-A-2 283 976 discloses a bobbin dyeing apparatus. The other references are random examples of art in the field to which the present invention belongs.

BACKGROUND OF THE INVENTION

The present invention relates to a method of treating yarns, and more particularly to improvements in a method of producing a twisted yarn, especially a dyed or bleached yarn.

In the making of dyed twisted yarns wherein the twisting operation is preceded by the step of doubling two or more single yarns, it is necessary to rewind the yarn three or four times, depending on the requirements regarding the run-off characteristics of the twisted yarn. The first rewinding operation takes place during doubling of two or more single yarns, the second rewinding operation takes place during twisting, and the third rewinding operation is carried out during lubricating which follows the dyeing step. If the twisted yarn is to exhibit exceptionally satisfactory run-off characteristics and should constitute a high-quality product, it is necessary to form a precision package upon completion of the twisting operation.

Each rewinding of the yarn involves an additional expenditure and is likely to entail yarn breakage with the need for the making of additional knots which, in turn, create problems during further processing of the yarn. Furthermore, each rewinding operation invariably affects the quality of the surface of the yarn.

OBJECTS AND SUMMARY OF THE INVENTION

An object of the invention is to provide a novel and improved method of treating yarns, especially of producing dyed or bleached twisted yarns, which necessitates fewer rewinding operations than the heretofore known methods.

Another object of the invention is to provide a method which renders it possible to form a high-quality twisted yarn.

A further object of the invention is to provide a method which renders it possible to effect a highly uniform dyeing of each and every portion of the yarn including the points where the sections of single yarns cross each other.

An additional object of the invention is to provide a method which renders it possible to form a twisted yarn having a highly satisfactory surface, highly satisfactory run-off characteristics and fewer knots than a yarn which is twisted in accordance with heretofore known techniques.

Still another object of the invention is to provide a yarn which is obtained in accordance with the above outlined method.

An additional object of the invention is to provide a precision package of twisted or doubled yarn which is obtained in accordance with the above outlined method.

One feature of the invention resides in the provision of a method of producing a twisted yarn. The method comprises the steps of precision doubling several single yarns to form a precision package, impregnating the precision package with a liquid medium (such as a dye liquor or a bleaching agent), and withdrawing and simultaneously twisting the thus impregnated yarn.

The liquid medium can contain a dye liquor and a lubricating agent or a dye liquor and a softening agent. Alternatively, the yarn which has been dyed or bleached in the form of a precision package is contacted with a lubricating agent in the course of the twisting step.

The method can further comprise the step of converting the twisted yarn into a precision package.

Another feature of the invention resides in the provision of a precision package which is produced in accordance with the improved method, i.e., a precision package which contains several doubled single yarns or a precision package containing twisted yarn which has been bleached or dyed subsequent to the formation of a precision package consisting of several doubled single yarns.

A further feature of the invention resides in the provision of twisted yarn which is produced in accordance with the above outlined method and constitutes a dyed or bleached doubled yarn, e.g., a precision package of such twisted yarn.

DESCRIPTION OF THE PREFERRED EMBODIMENTS

The improved method need not comprise more than three steps, namely a first step of precision doubling two or more single yarns to form a precision package, a second step of treating (especially impregnating) the precision package with a liquid medium, particularly a dye liquor (which can contain a lubricating agent or a softening agent) or a bleaching agent, and a third step of withdrawing and simultaneously twisting the dyed or bleached yarn.

The precision doubling step involves the making of a homogeneous package having a constant winding ratio, a constant helix angle and uniform mutual spacing of the windings. The making of such precision package establishes optimal conditions for the dyeing or bleaching operation which can involve the outflow of a liquid medium through a hollow permeable core and simultaneous flow of such liquid medium inwardly from the exposed surfaces of the package. This will be readily appreciated since the dyeing or bleaching operation which constitutes a step of the improved method involves the step of contacting the liquid medium with several doubled single yarns prior to their twisting so that the crossing points which are formed in the course of the twisting operation contain yarn portions all of which have been dyed or bleached to the same extent. It has been found that the dyeing or bleaching of a doubled yarn is incomparably more uniform than if the dyeing or bleaching were to take place upon completion of the twisting step. The color shade of a dyed doubled yarn is surprisingly uniform from end to end.

The density of a precision package exceeds considerably the density of a standard package. This renders it possible to increase the capacity of the yarn processing plant by between 30 and 40 percent without further investments and with pronounced reduction of the quantities of liquid medium.

Another important advantage of the improved method is that the edge crimping of package flanges is eliminated or reduced to a minimum, and also that the percentage of waste due to deviations of density from the desired value is a small fraction of the percentage of waste which is produced if the dyeing or bleaching precedes the twisting operation.

Since the making of a precision package entails an increase of density by up to 30 percent, the bulk of such package is a fraction of that of a standard package containing the same length of yarn. The making of a relatively small and compact precision package results in savings of energy in the course of the next-following (twisting) step. Still further, the yarn is subjected to lesser tensional stresses because the balloons are much smaller. Moreover, the precision doubling feed from the large spool diameter to the small diameter takes place without any noticeable reduction of yarn storage on the two-for-one spindle.

The method further entails a substantial reduction of labor costs due to fewer and shorter periods of standstill, complete run-off and considerable length of the yarn and fewer knots. Moreover, the quality of the treated yarn is highly satisfactory, and the dyeing operation results in the making of voluminous round yarn which, when constituting an open-end yarn, is highly satisfactory for the making of stylish knit outer garments.

Still another important advantage of the improved method is that it allows for substantial automation of plants for the making of dyed and twisted yarns.

EXAMPLE

The first step involved the withdrawal of two or more open-end or ring-spun yarns in a precision assembly winder (also called doubler) to form a homogeneous precision package with a constant winding ratio and a constant helix angle as well as uniform spacing of the windings and a density exceeding by approximately 30 percent that of a random-wound bobbin.

The second step was carried out immediately following completion of the first step and involved dyeing of the precision package. Such dyeing operation involved the utilization of a surprisingly small quantity of dye liquor. This is believed to be attributable to the much higher density of a precision package, i.e., to greater length of the yarn per unit volume. At any rate, the quantity of dye liquor per kilogram of yarn is much lower than in connection with the dyeing of twisted yarns. Furthermore, an autoclave can be used to dye 30–40 percent more yarn per cycle, without any additional investments, than in connection with the dyeing of twisted yarns.

The second step can involve impregnating the precision package with a bleaching agent in lieu of dye liquor.

The third step involved twisting of the doubled and dyed or bleached yarn directly off the precision package. The run-off characteristics of the dyed or bleached yarn were highly satisfactory which is believed to be attributable to a pronounced reduction of the number of knots. The run-off characteristics of the dyed yarn were improved still further by adding a lubricating agent to dye liquid during the last dyeing cycle. As stated above, the dimensions of the precision package (in comparison with a standard package containing the same length of yarn) are surprisingly small because the precision package is denser by up to 30 percent. Consequently, the diameter of the balloon is also smaller than that of a standard balloon which, in turn, enhances the output of the twisting machine.

If the method is to result in the production of a sewing thread, the yarn is or can be contacted by a lubricating agent in the course of the twisting step. An additional step can involve conversion of twisted and lubricated yarn directly into a precision package of sewing thread.

The improved method renders it possible to form threads from single yarns which are produced in open end spinning machines, friction spinning machines or air jet spinning machines. As concerns the overall cost and versatility, the improved threads are at least equivalent or superior to conventional ring-spun yarns having the same final yarn count.

The term "precision package" is intended to denote a package of the type defined by the DIN nomenclature (reference may be had particularly to German DIN-Norm No. 61 801 of August 1975). Generally speaking, a precision package is a bobbin having layers of precision windings. This also embraces the data processor-controlled package and bobbin build.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of producing twisted yarn, comprising the steps of precision doubling several single yarns on a precision winding machine to form a homogenous high-density precision package of untwisted yarn; treating the precision package with a liquid medium; and withdrawing and simultaneously twisting the treated yarn.

2. The method of claim 1, wherein the liquid medium contains dye liquor and a lubricating agent.

3. The method of claim 1, wherein the liquid medium contains dye liquor and a softening agent.

4. The method of claim 1, further comprising the step of contacting the yarn with a lubricating agent in the course of said twisting step.

5. The method of claim 1, wherein the liquid medium contains a bleaching agent.

6. The method of claim 1, further comprising the step of converting the twisted yarn into a precision wound package.

* * * * *